US005924334A

United States Patent [19]

Hara et al.

[11] Patent Number: 5,924,334

[45] Date of Patent: Jul. 20, 1999

[54] DEVICE FOR MOVING CAM RELATIVE TO ITS DRIVING SHAFT

[75] Inventors: Seinosuke Hara; Akira Hidaka; Yoshihiko Yamada, all of Atsugi; Shinichi Takemura, Fujisawa, all of Japan

[73] Assignee: Unisia Jecs Corporation, Atsugi, Japan

[21] Appl. No.: 08/905,962

[22] Filed: Aug. 5, 1997

[30] Foreign Application Priority Data

| | | | |
|---|---|---|---|
| Aug. 5, 1996 | [JP] | Japan | 8-205141 |
| Aug. 30, 1996 | [JP] | Japan | 8-230262 |
| May 27, 1997 | [JP] | Japan | 9-136252 |

[51] Int. Cl.[6] ..... F01L 13/00

[52] U.S. Cl. ..... 74/568 R; 123/90.17; 74/567; 464/160

[58] Field of Search ..... 74/567, 569, 568 R; 123/90.17, 90.18, 90.31, 90.16, 90.34; 464/1, 160

[56] References Cited

U.S. PATENT DOCUMENTS

| | | | |
|---|---|---|---|
| 3,633,555 | 1/1972 | Raggi | 123/90.17 |
| 5,056,478 | 10/1991 | Ma | 123/90.31 X |
| 5,161,493 | 11/1992 | Ma | 464/1 X |
| 5,333,579 | 8/1994 | Hara et al. | 123/90.17 |
| 5,361,736 | 11/1994 | Phoenix et al. | 74/568 R X |
| 5,365,896 | 11/1994 | Hara et al. | 123/90.17 |
| 5,494,009 | 2/1996 | Yamada et al. | 123/90.17 |
| 5,553,573 | 9/1996 | Hara et al. | 123/90.15 |
| 5,557,983 | 9/1996 | Hara et al. | 74/568 R |
| 5,592,908 | 1/1997 | Hara et al. | 123/90.17 |
| 5,687,681 | 11/1997 | Hara | 123/90.17 |

FOREIGN PATENT DOCUMENTS

| | | | |
|---|---|---|---|
| 1-285611 | 11/1989 | Japan | 123/90.17 |
| 4-43805 | 2/1992 | Japan | 123/90.17 |
| 7-34831 | 2/1995 | Japan . | |

*Primary Examiner*—Vinh T. Luong
*Attorney, Agent, or Firm*—Foley & Lardner

[57] ABSTRACT

A device for moving a hollow cam relative to a driving shaft includes an intermediate member between a drive member fixed to the driving shaft and a driven member fixe to the hollow cam. A cam ring in the form of an eccentric cam is disposed between the driving shaft and the intermediate member to maintain eccentric rotation of the intermediate member relative to the driving shaft. A driver mechanism controls the angular position of the cam ring.

12 Claims, 14 Drawing Sheets

DEVICE FOR MOVING CAM RELATIVE TO ITS DRIVING SHAFT

BACKGROUND OF THE INVENTION

1. Field of the Invention

The present invention relates to a device for moving a cam relative to its driving shaft. The invention can be used for a camshaft of an internal combustion engine for varying duration of opening of an intake or exhaust valve or phase of opening and closing of the valve in a dual overhead camshaft internal combustion engine.

2. Description of the Related Art

U.S. Pat. No. 5,365,896 discloses a device for moving a hollow cam relative to its driving shaft that is driven by a crankshaft of an engine for rotation about a shaft axis. The device includes a drive member connected to the driving shaft, a driven member connected to the hollow cam and an intermediate member operatively connected between the drive and driven members. A support has mounted therein the intermediate member. The intermediate member has an axis and a central hole that is wide enough to allow limited movement of the support to vary eccentricity of the axis thereof with respect to the shaft axis. The drive member is coupled with the intermediate member by a first coupling at a first position spaced from the shaft axis. The driven member is coupled with the intermediate member by a second coupling at a second position that is spaced in angular direction with respect to the shaft axis. Each of the first and second couplings has a movable connection with the intermediate member to permit variation in its distance from the axis of the intermediate member during operation. The support is pivoted via a pivot shaft to a framing structure for movement within a plane perpendicular to the shaft axis. The framing structure is fixedly mounted to a cylinder head of the associated engine. To move the support, an actuator rotates via a control rod an eccentric cam that is received in a hole of the support. Both the actuator and control rod are also mounted to the framing structure.

According to the known device, the pivot shaft is needed for the support, thus increasing the number of component parts and requiring increased installation space.

In addition to a bearing structure for the hollow cam, another independent structure is required for supporting the pivot shaft, making it difficult to find installation space above the cylinder head.

The fact that the support is pivoted makes it difficult to adjust the intermediate member with respect to the shaft axis, causing a deviation from a desired valve timing control. This also causes cylinder to cylinder variation in valve timing, increasing probability of occurrence of irregular operation due to cylinder to cylinder variation in power output.

As the hollow cam opens the associated cylinder valve against its valve spring, the reaction is transmitted via the first and second couplings to the intermediate member and then to the support. At only two spaced points, the support must bear stress due to the valve spring. Thus, the support bends at a portion between the two spaced points, causing undesired deviation of the axis of the intermediate member from the shaft axis, causing a deviation from desired valve timing.

U.S. Pat. No. 5,333,579 discloses a known device similar to the device discussed above.

An object of the present invention is to improve the device of the above kind such that the support for the intermediate member is not employed.

SUMMARY OF THE INVENTION

According to the present invention, there is provided a device for moving a cam relative to a driving shaft, comprising:

a driving shaft having a shaft axis;

a hollow cam concentric with said driving shaft, said hollow cam having one end portion and opposite end portion;

a drive member fixed to said driving shaft;

a driven member fixed said hollow cam at said one end portion thereof;

an intermediate member having an axis and disposed between said drive and driven members;

a first coupling connecting said drive member with said intermediate member at a first position spaced from said shaft axis;

a second coupling connecting said driven member with said intermediate member at a second position spaced from said shaft axis and spaced in an angular direction, with respect to said shaft axis, from said first position;

said intermediate member having a central bore through which said driving shaft extends;

a cam ring disposed within said central bore between said driving shaft and said intermediate member, said cam ring supporting said intermediate member.

DESCRIPTION OF THE PREFERRED EMBODIMENTS

Figure 1:
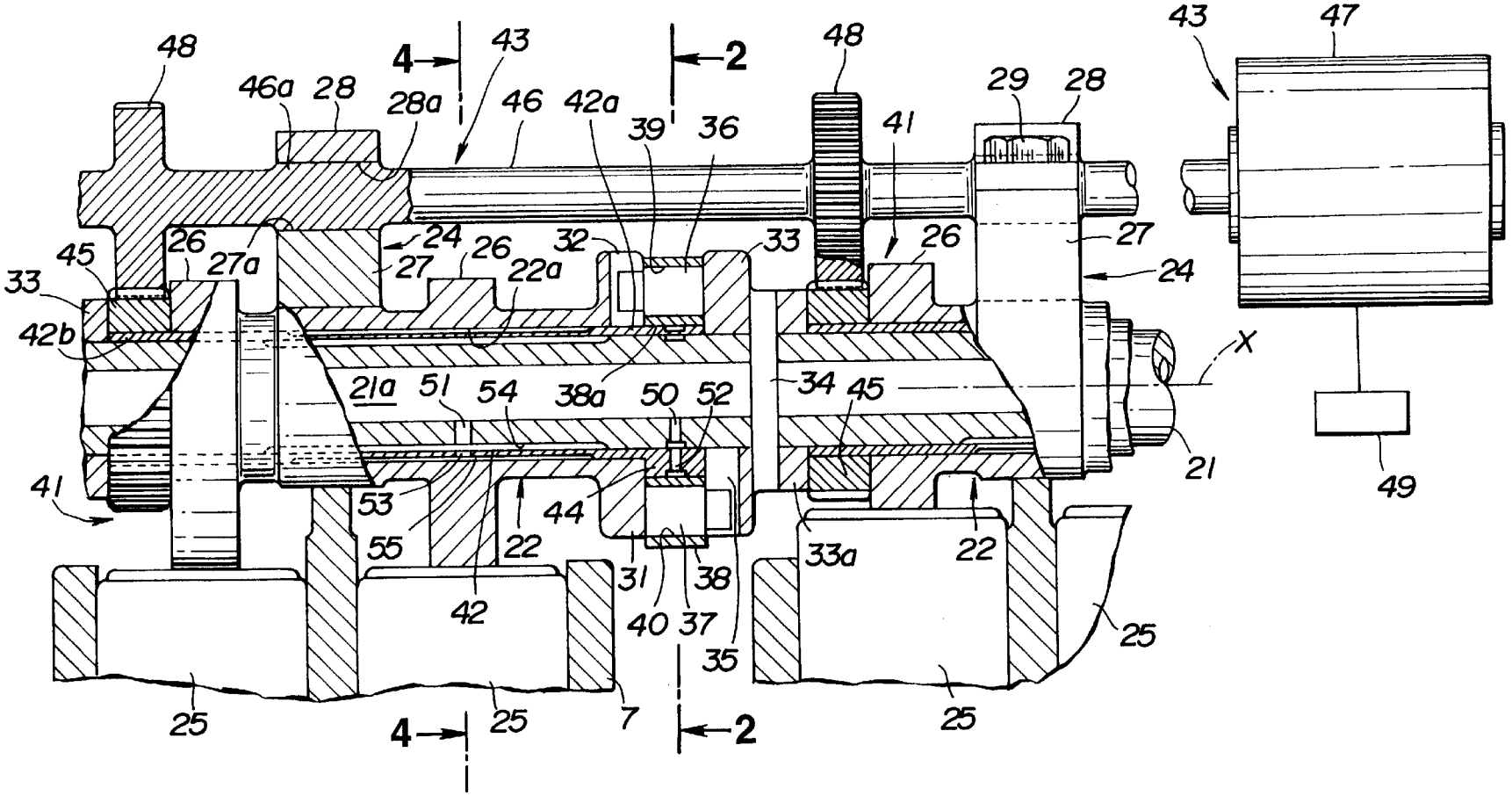
FIG. 1 is a fragmentary view, partly broken away, of a first embodiment of a device according to the present invention.

Referring to the accompanying drawings, like reference numerals and characters are used to throughout all of the Figures to denote like or similar parts or portions for the sake of simplicity of description.

In FIG. 1, the reference numeral 7 indicates a portion of a cylinder head of a dual overhead cam internal combustion engine. The engine has four cylinders arranged in line. For each of the four cylinders, four cylinder valves are arranged. They can be divided into a first group of eight cylinder valves and a second group of eight cylinder valves. The cylinder valves belonging to the first group are biased closed by valve springs, respectively, and are lifted by intake cams, respectively, against their valve springs to perform intake phase of the corresponding cylinders. The cylinder valves belonging to second group are biased closed by valve springs, respectively, and are lifted by exhaust cams, respectively, against their valve springs to perform exhaust phase of the corresponding cylinders.

Figure 2:
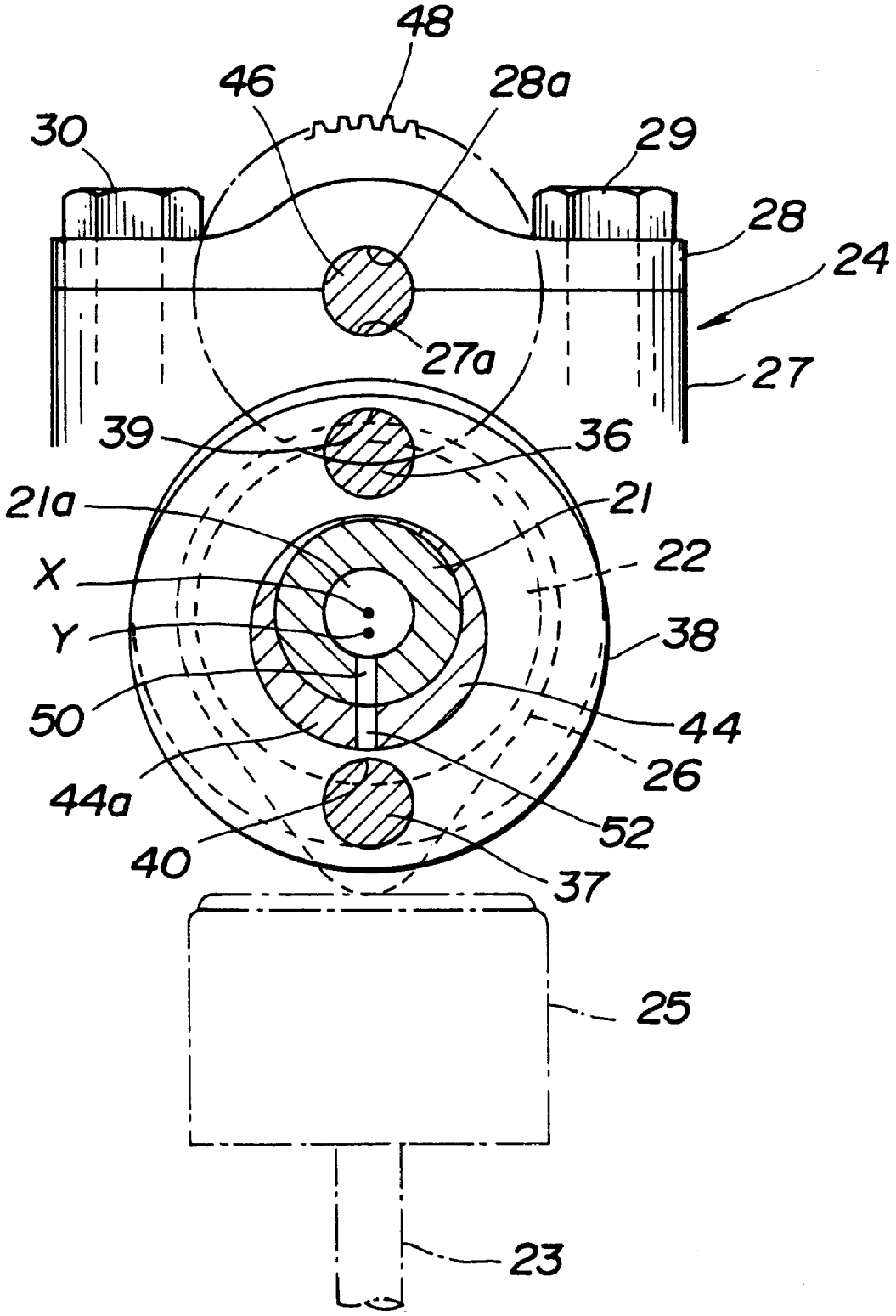
FIG. 2 is a section taken through the line 2—2 in FIG. 1.
Figure 3:
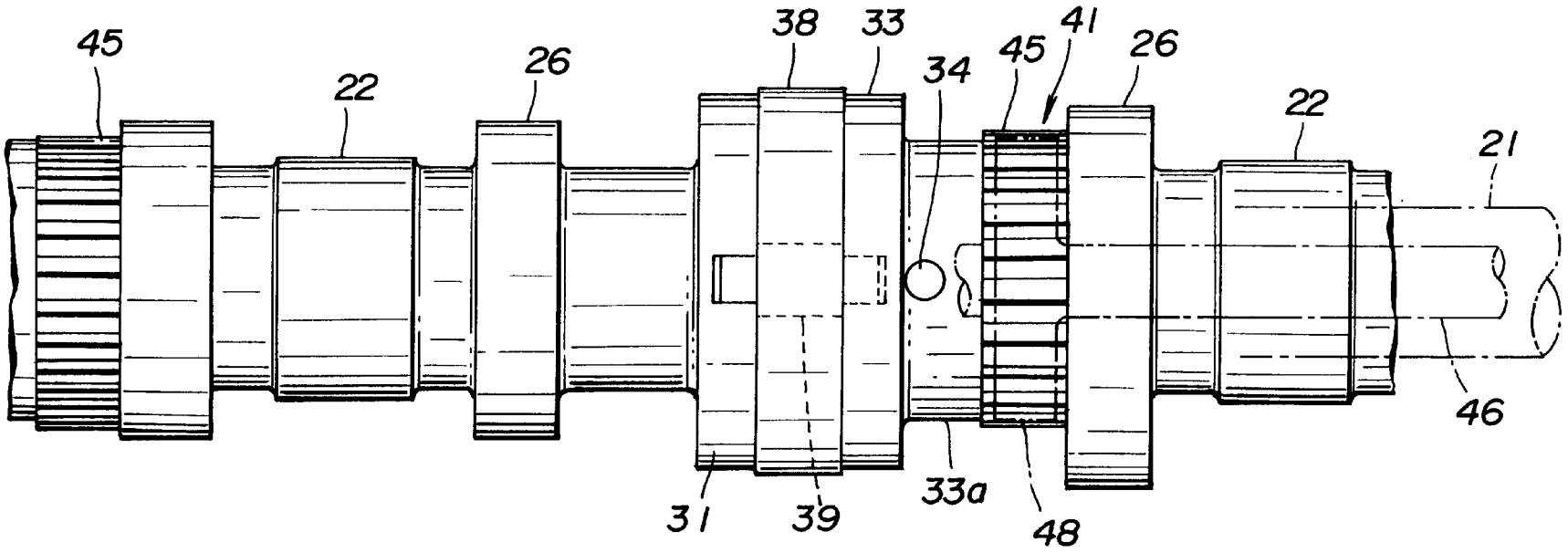
FIG. 3 is a top plan view of the device.

In the first embodiment shown in FIG.1, the present invention is applied to a phase changing mechanism incorporated in intake cam drive gear for intake valves 23 (see FIG. 2). The invention may be equally applicable to the exhaust valves. The intake valves 23 have valve lifters 25, respectively. Instead of a single conventional intake camshaft, four hollow cams 22, among which only two are shown in FIG. 1. Each of the hollow cams 22 has two axially spaced cam lobes 26 for cooperation with the two valve lifters 25 of the associated one of the cylinders. The hollow cams 22 are supported by spaced cam bearings 24 that are secured to the cylinder head 7. Extending through a central tore 22*a* of each of the hollow cams 22 is a driving shaft 21. The driving shaft 21 is driven to rotate about a shaft axis X by conventional means such as a sprocket and a chain.

Each of the cam bearings 24 includes a main bracket cooperating with one of bearing surfaces formed on the cylinder head 7 and a sub bracket 28 on top of the main bracket 27. Two bolts 29 and 30 (see FIG. 2) extend through the sub bracket 28 and the man bracket 27. The main bracket 27 has a bearing surface 27*a* recessed from the top thereof, while the sub bracket 28 has a bearing surface 28*a* recessed from the bottom thereof. These bearing surfaces 27*a* and 28*a* cooperate with each other to form a bearing supporting a control rod 46.

The hollow cams 22, which are supported in the above mentioned cam bearings 24, support the driving shaft 21. The hollow cams 22 are maintained in concentric relation with the driving shaft 21 for rotation about the shaft axis X.

A plurality of, four in this embodiment, drive members 33 are fixedly coupled with the driving shaft 21 and arranged to drive the hollow cams 22, respectively. In FIG. 1, only one of such drive members 33 is illustrated. There are a plurality, four in this embodiment, driven members 31, which are integrally formed at axial end portions of the hollow cams 22, respectively. In FIG. 1, only one of such driven members 31 is illustrated. Each of the drive members 33 mates with one of driven members 31. Disposed between the mated drive and driven members 33 and 31 is an intermediate member 38.

The drive member 33 is in the form of a drive disc and includes an integral sleeve 33*a* fixedly coupled with the driving shaft 21 for unitary rotation by a cotter pin 34. The driven member 31 is in the form of a driven disc integral with the one end of the corresponding hollow sleeve 22.

The intermediate member 38 is in the form of an annular disc that has a central hole 38*a*, through which the driving shaft 21 to pass. The central hole 38*a* is wide enough to allow insertion of a cam ring 44, in the form of an eccentric cam ring, within a space defined between the central hole 38*a* defining inner wall of the annular disc 38 and the outer surface of the driving shaft 21. This cam ring 44 supports the annular disc 38 for rotation about an axis Y. Rotational movement of the cam ring 44 about the shaft axis X causes movement of the annular disc 38 in a plane perpendicular to the shaft axis X and alters direction of eccentricity of the axis Y with respect to the shaft axis X.

As seen in FIG. 2, the radial, with respect to the shaft axis X, dimension of the cam ring 44 varies gradually in a direction of the circumference of an outer circle of the cam ring 44. The radial dimension gradually decreases from the maximum to the minimum over 180 degrees angular displacement about the shaft axis X, and gradually increases from the minimum to the maximum over the next 180 degrees angular displacement about the shaft axis X. In FIG. 2, the reference numeral 44*a* indicates a maximum thickened portion at which the radial dimension is maximized.

For transfer of torque from the drive member 33 to the intermediate member 38, a first coupling couples the drive member 33 with the intermediate 38 at a first position spaced from the shaft axis X. For transfer of torque from the intermediate member 38 to the driven member 31, a second coupling couples the driven member 31 with the intermediate member 38 at a second position spaced from the shaft axis X. The first and second positions are displaced in an angular direction about the axis Y of the intermediate member 38. In this embodiment, the second position is displaced in the angular direction from the first position through 180 degrees. The first coupling has a movable connection with the intermediate member 38 to permit variation in a distance of the first position. During rotation of the driving shaft 21, the first coupling has a movable connection with the intermediate member 38 to permit variation in a distance of the first position from the shaft axis X. The second coupling has a movable connection with the intermediate member 38 to permit variation in a distance of the second position from the shaft axis X.

The first coupling includes a first radial 35 formed in the face of the drive member 33 which is opposed to the intermediate member 38 and a first pin 37 received at one end in a pin receiving bore 40 of the intermediate member 38. At the opposite end portion, the first pin 37 engages in the first radial groove 35. The second coupling includes a second radial groove 32 in the face of the driven member 31 which is opposed to the intermediate member 38 and a second pin 36 received at one end in a pin receiving bore 39 of the intermediate member 38. At the opposite end portion, the second pin 36 engages in the second radial groove 32. The first and second radial grooves 35 and 32 end radially outwardly from the shaft axis X in the opposite direction During operation, the intermediate member 38 rotates eccentrically with respect to the shaft axis X. The first pin 37 moves along the radial groove 35 varying its distance from the shaft axis X, while the second pin 36 moved along the radial groove 32 varying its distance from the shaft axis X. In other words, the first coupling couples the drive member 33 with the intermediate member 38 at the first position where the first pin 37 is and has the movable connection defined by the first pin 37 and the radial groove 35. The second coupling couples the driven member 31 with the intermediate member 38 at the second position where the second pin 36 is and has the movable connection defined by the second pin 36 and the radial groove 32.

In this embodiment, the cam ring 44 has a first position where the thickened portion 44*a* assumes the lowest position with respect to the shaft axis X as illustrated in FIG. 2 and a second position where the thickened portion 44*a* assumes the highest position. For positioning the cam ring 44 to the first position or the second position, a driver mechanism 43 controls the angular position of each of the cam rings 44 via the corresponding one of transfer mechanisms 41.

Referring to FIGS. 1 and 2, the transfer mechanism 41 includes a torque transmission member 42 that is disposed between the outer surface of the driving shaft 21 and the inner surface of the hollow cam 22. The torque transmission member 42 is connected at one end 42*a* to the cam ring 44. At the opposite end 42*b*, the sleeve 42 fixedly carries a gear 45. The transfer mechanism 41 also includes a gear 48 of a control rod or shaft 46. The gears 45 and 48 are intermeshed.

In this embodiment, the torque transmission member 42 is in the form of a sleeve. At the one end 42*a*, the sleeve 42 is integrated with the cam ring 44. At the opposite end 42*b*, the sleeve 42 is press fitted into the central bore of the gear 45. Thus, the gear 45, sleeve 42 and cam ring 44 can rotate as a unit. The gear 45 is disposed between the sleeve 33*a* of the drive member 33 and the adjacent end of the hollow cam 22.

The driver mechanism 43 includes the control shaft 46 and an actuator, in the form of a stepping motor 47. The control shaft 46 is supported at longitudinally spaced diametrically enlarged portions 46*a* by cam bearings 24. The mating bearing surfaces 27*a* and 28*a* of each of the cam bearings 24 surround the corresponding one of the diametrically enlarged portions 46*a*. Between the adjacent two of the diametrically enlarged portions 46*a*, the above-mentioned gear 48 is disposed and forms an integral part of the control shaft 46. The stepping motor 47 is connected to a controller 49. The controller 49 receives information from various sensors, such as a crankshaft angle sensor and an airflow meter, determines which angular position the cam ring 44 should take and outputs a control signal on which the stepping motor 47 operates.

Figure 4:
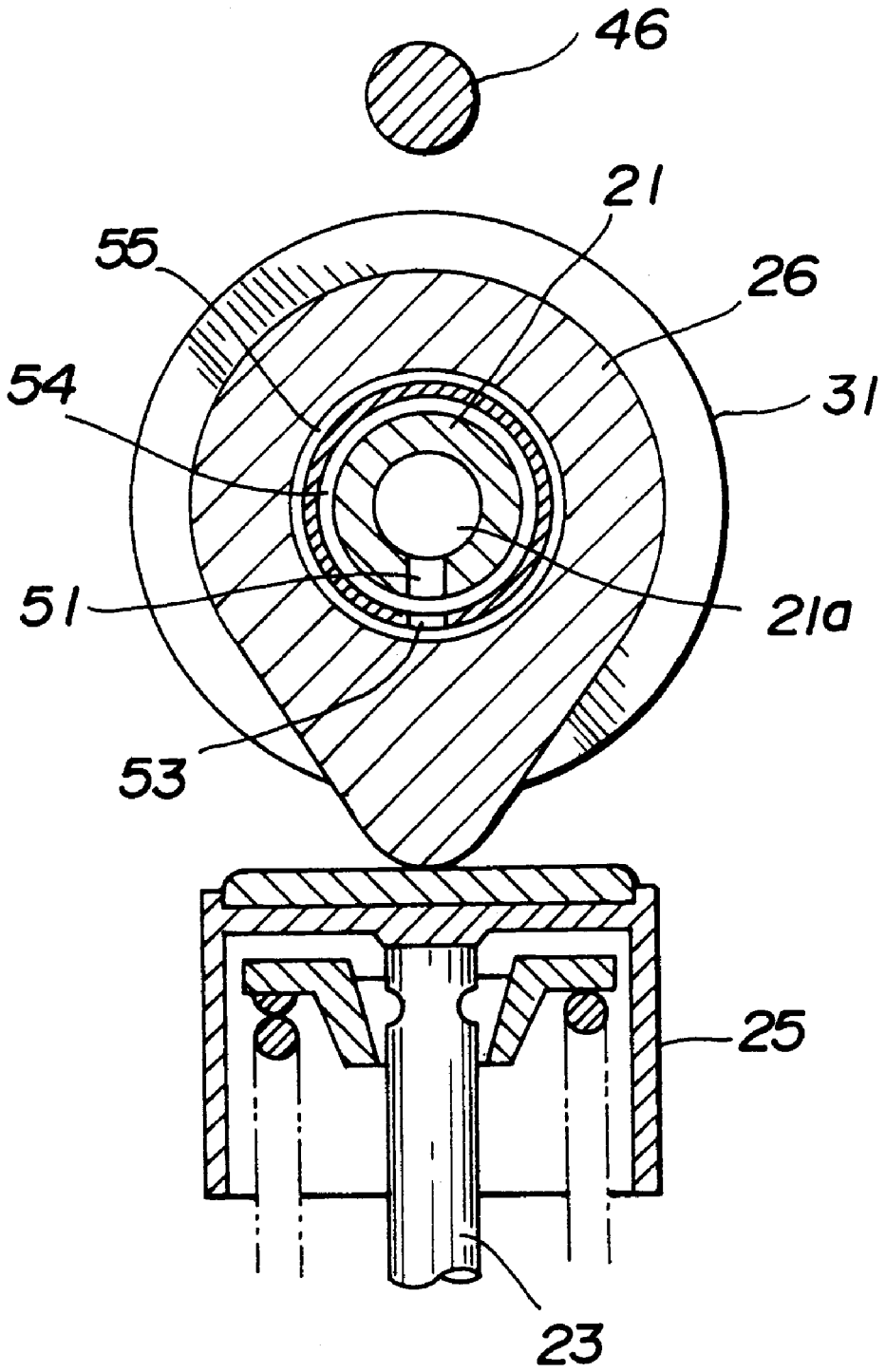
FIG. 4 is a section taken through the line 4—4 in FIG. 1.

For supply of lubricating oil, the driving shaft 21 is formed with a supply passage 21*a*. Referring to FIGS. 1 and 2, at the portions of the driving shaft 21, which are in direct contact with the cam rings 44, respectively, the driving shaft 21 is formed with first radial passages, only one being shown and indicated at 50. The first radial passages 50 communicate at their inner ends with the supply passage 21*a*. Referring to FIGS. 1 and 4, at the portions of the driving shaft 21, which are disposed around midpoints of the longitudinal line segments of the sleeves 42, the driving shaft 21 is formed with second radial passages, only one being shown and indicated at 51. The second radial passages 51 communicate at their inner ends with the supply passage 21*a*.

As best seen in FIG. 2, the cam ring 44 is formed with a radial passage 52 that communicates at its inner end with the outer end of the radial passage 50. The radial passage 52 extends through the thickened portion 44*a* of the cam ring 44.

As best seen in FIG. 4, the sleeve 42 is formed with a radial port 53 that is opposed to the outer end of the radial passage 51. The radial port 53 is smaller in diameter than the radial passage 51.

As readily seen from FIGS. 1 and 4, the driving shaft 21 is recessed from the outer surface thereof at spaced portions that are covered by the sleeves 42, respectively, to form first oil reservoirs, only one being and indicated at 54 in FIG. 1. Each of the first oil reservoirs 53 establishes flow communication between the adjacent radial passage 51 and its mating radial opening 53. Each of the sleeves 42 is recessed from the outer surface thereof at the portion that is covered by the associated hollow cam 22 to form a second oil reservoir 55. Each of the second oil reservoirs 55 communicates with the corresponding radial opening 53.

The second oil reservoir 55 extends between the one and the opposite end portions 42*a* and 42*b* of the sleeve 42 in a direction along the shaft axis X. Besides, the second oil reservoir 55 extends continuously about the shaft axis X. The first oil reservoir 54 extends continuously about the shaft axis X and has an axial extension along the shaft axis X shorter than the axial distance between which the one portion 42*a* and the opposite end portion 42*b* of the sleeve 42 are spaced.

The provision of the first oil reservoir 54 allows contact of the sleeve 42 with the outer surface of the driving shaft 21 at two axially spaced inner surfaces of the one and the opposite end portions 42*a* and 42*b*. The provision of the second oil reservoir 55 allows contact of the sleeve 42 with the bore 22*a* defining inner surface of the hollow cam 22 at two axially spaced outer surfaces of the one and the opposite end portions 42*a* and 42*b*.

Figures 5A, 5B, 5C:
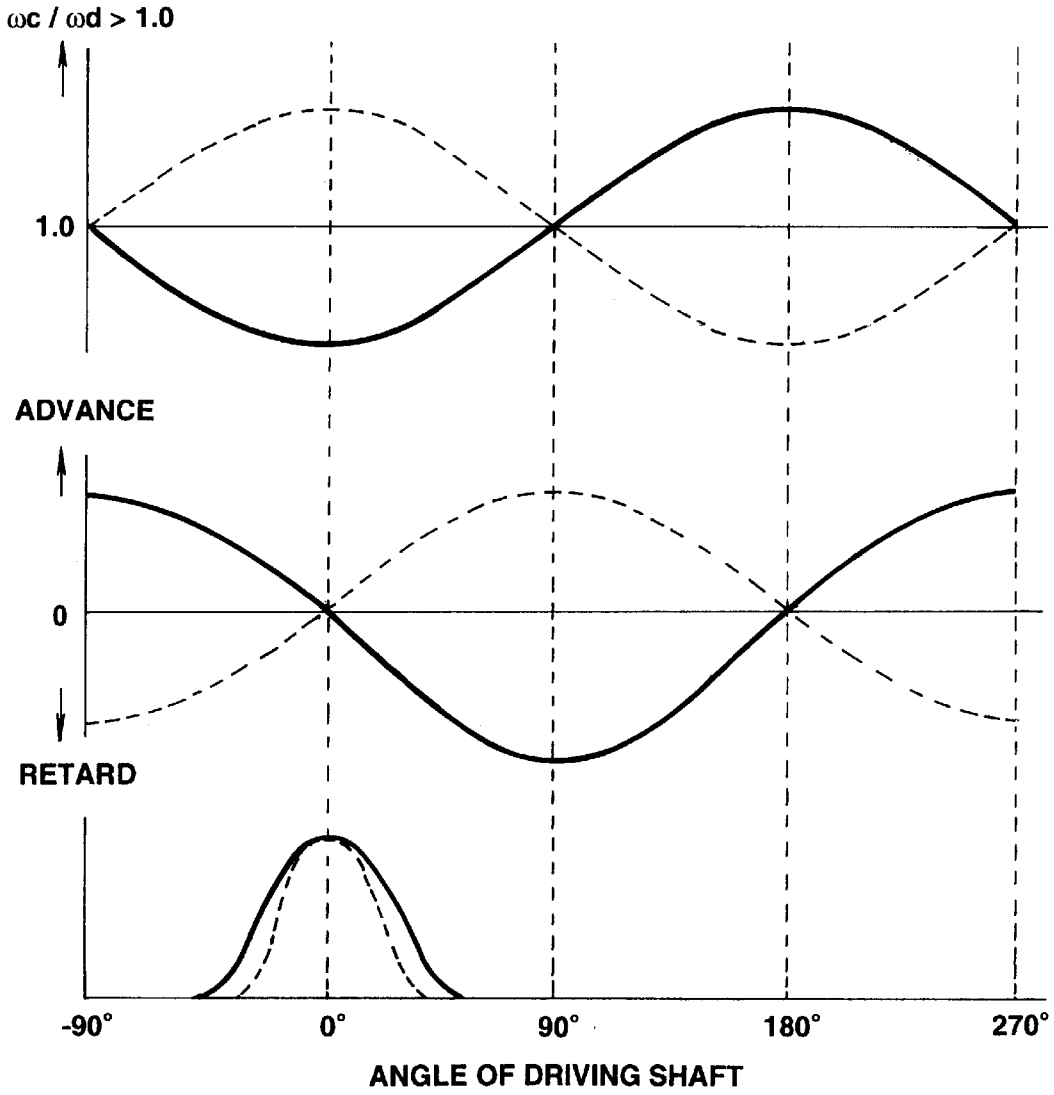
FIG. 5(A) is a graph illustrating the variation of the angular speed of a hollow cam relative to the angular speed of a driving shaft.
FIG. 5(B) is a graph illustrating the variation of the phase of the hollow cam.
FIG. 5(C) is a valve lift diagram.
Figure 6:
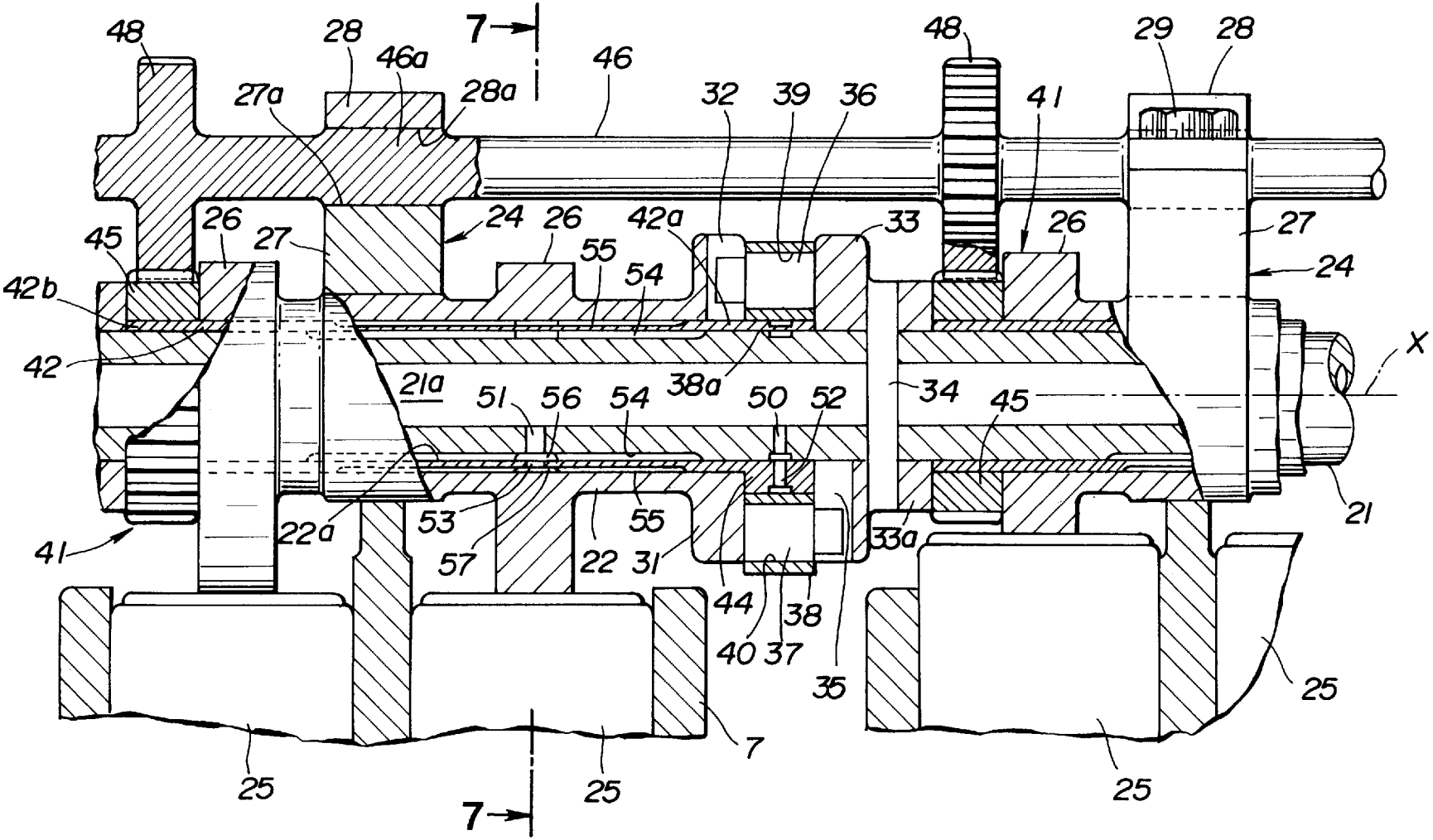
FIG. 6 is a similar view to FIG. 1, illustrating a second embodiment.
Figure 7:
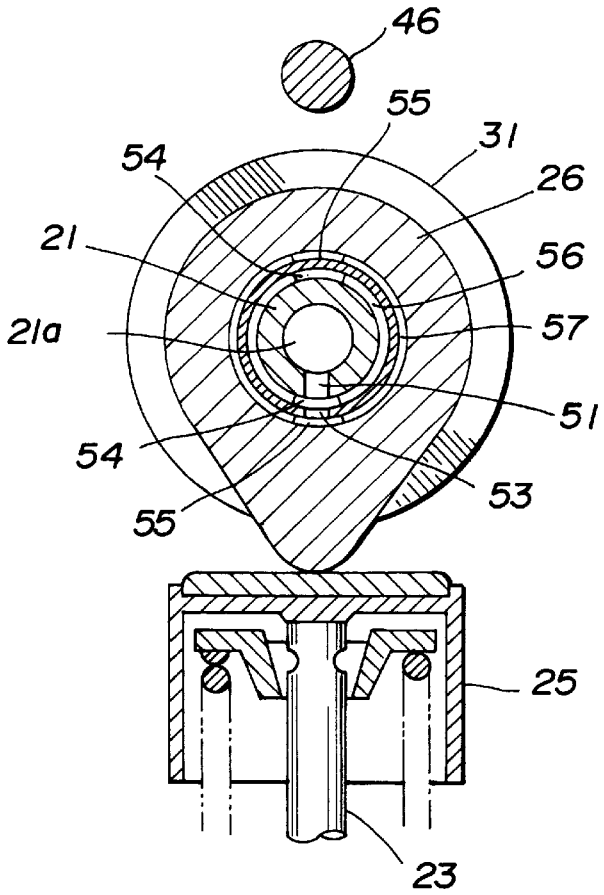
FIG. 7 is a section taken through the line 7—7 in FIG. 6.

Referring also to FIGS. 5(A), 5(B) and 5(C), during operation at low engine speeds, the controller 49 outputs a control signal to cause the stepping motor 47 to adjust the cam ring 44 to the first position as illustrated in FIG. 2. In the first position, the thickened portion 44*a* is directed downwards, viewing in FIG. 2. In other words, the thickened portion 44*a* is the nearest the associated valve lifter 25, and the axis Y is displaced from the shaft axis X toward the associated valve lifter 25. Under this condition, the angular speed of the intermediate member 38 is no longer equal to the angular speed $\omega_d$ of the driving shaft 21. The dotted line shown in FIG. 6(A) shows the variation of the angular speed $\omega_c$ of the hollow cam 22, and the dotted line shown in FIG. 6(B) the variation of the phase of the hollow cam 22. It is now understood that the hollow cam 22 is retarded during the acceleration phase of the hollow cam 22, while it is advanced during the deceleration phase of the hollow cam 22. The top of each of the cam lobes 26 is diametrically opposed, with respect to the shaft axis X, to the radial groove 32 of the driven member 31. The duration of opening of the valve becomes the shortest at the angular position of the cam ring 44 as illustrated in FIG. 2. The dotted line in FIG. 5(C) illustrates the valve lift diagram under this condition.

Upon shift from low engine speed operation to high engine speed operation, the controller 49 instructs the stepping motor 47 to turn the control shaft 46 through predetermined angles, for example 180 degrees. This turns the gear 45 and sleeve 42 until the cam ring 44 turns 180 degrees from the position illustrated in FIG. 2 to the second position. In the second position, the thickened portion 44*a* is directed upwards, viewing in FIG. 2. In other words, the thickened portion 44*a* is the remotest from the associated valve lifter 25, and the axis Y is displaced from the shaft axis X away from the associated valve lifter 25. The fully drawn line shown in FIG. 5(A) illustrates the variation of the angular speed of the hollow cam 22. The fully drawn line shown in FIG. 5(B) illustrates the variation of the phase of the hollow cam 22. It is noted that the hollow cam 22 is advanced during the deceleration phase of the hollow cam 22, while it is retarded during the acceleration phase of the hollow cam 22. The fully drawn line shown in FIG. 5(C) shows the valve lift diagram. From this, it is appreciated that the duration of opening of the valve becomes the longest under this condition.

According to the previously described embodiment, the intermediate member 38 is supported via the cam ring 44 on the driving shaft 21. Thus, the pivot shaft and its associated structure, which are required in the prior art devices, are no longer needed.

As the driving shaft 21 supports the intermediate member 38 via the cam ring 22, it has become easier to adjust eccentricity of the axis T of the intermediate member relative to the shaft axis X.

As the cam ring 22 supports the intermediate member 38 through the central bore defining inner surface, the area through which the intermediate member 38 is supported has been reduced. Thus, the frictional resistance has been reduced.

Via the cam ring 44, the driving shaft 21 bears all of load imparted to the intermediate member 38 during operation. Thus, undesired displacement of the intermediate member 38, which has been encountered in the prior art device, upon application of large load has been eliminated or at least greatly suppressed.

Owing to the supply of lubricating oil via the radial passages 50 and 52, the cam ring 44 and the intermediate member 38 are sufficiently lubricated. Via the radial passage 51, radial port 53, and first and second oil reservoirs 54 and 55, the torque transmission sleeve 42 and the cam ring 44 are sufficiently lubricated.

Each of the hollow cams 22 is supported by the cam bearings 24. Besides, it is supported via the torque transmission sleeve 42 by the driving shaft 21. Thus, undesired movement of the hollow cams 22 during operation is sufficiently suppressed.

Owing to the provision of clearances in the form of oil reservoirs 54 and 55, the hollow cam 22 and the torque transmission sleeve 42 are supported at two axially spaced portions, respectively. Sticking of such components is prevented. It is no more necessary to hold required machining accuracy over the whole longitudinal length of them although such accuracy is required on each of the end portions or them.

Referring to FIGS. 6 to 9, a second embodiment is described. This second embodiment is substantially the same as the first embodiment except the constructions of first and second oil reservoirs of driving shaft and toque transmission sleeve, respectively.

Figure 8:
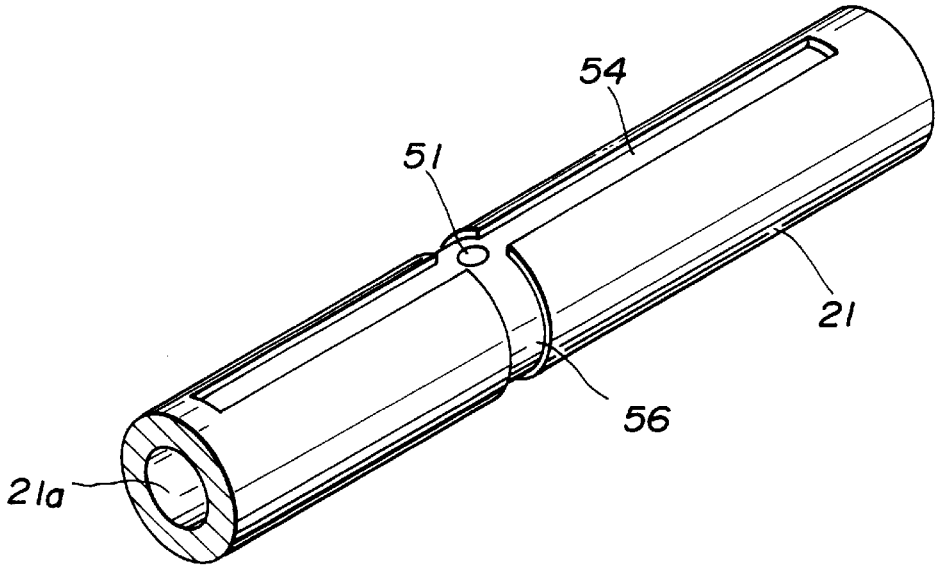
FIG. 8 is a perspective view of a driving shaft.

As best seen in FIG. 8, the first oil reservoir includes two axial oil grooves 54, first one being communicating with a radial passage 51, the other or second one being spaced in an angular direction from the first one. The first oil reservoir also includes a circumference groove 56 interconnecting the first and second axial grooves 54.

Figure 9:
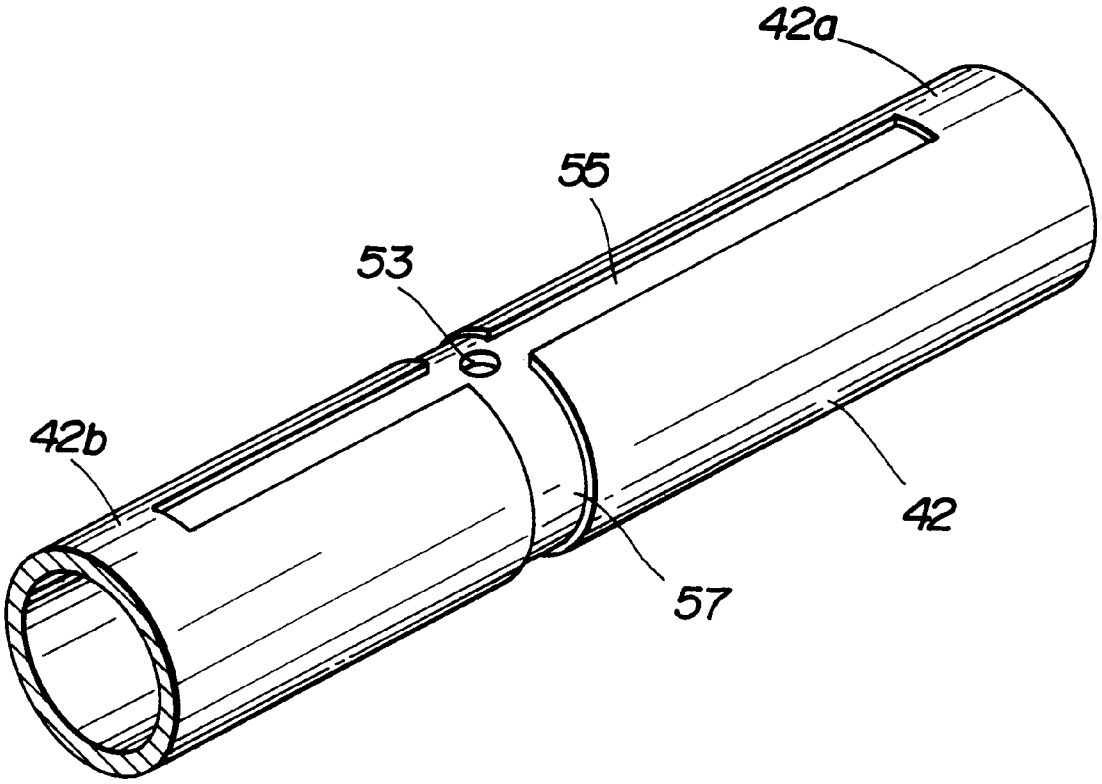
FIG. 9 is a perspective view of a torque transmission member.

As best seen in FIG. 9, the second oil reservoir includes two axial grooves 55, first one being communicating with a radial port 53, the other or second one being spaced in an angular direction from the first one. The second oil reservoir also includes a circumference groove 57 interconnecting the first and second axial grooves 55.

Referring to FIGS. 10 to 14, a third embodiment is described. This embodiment is substantially the same as the first embodiment except the employment of a link mechanism, instead of the gears 45 and 48, as each of transfer mechanisms 41.

Figure 10:
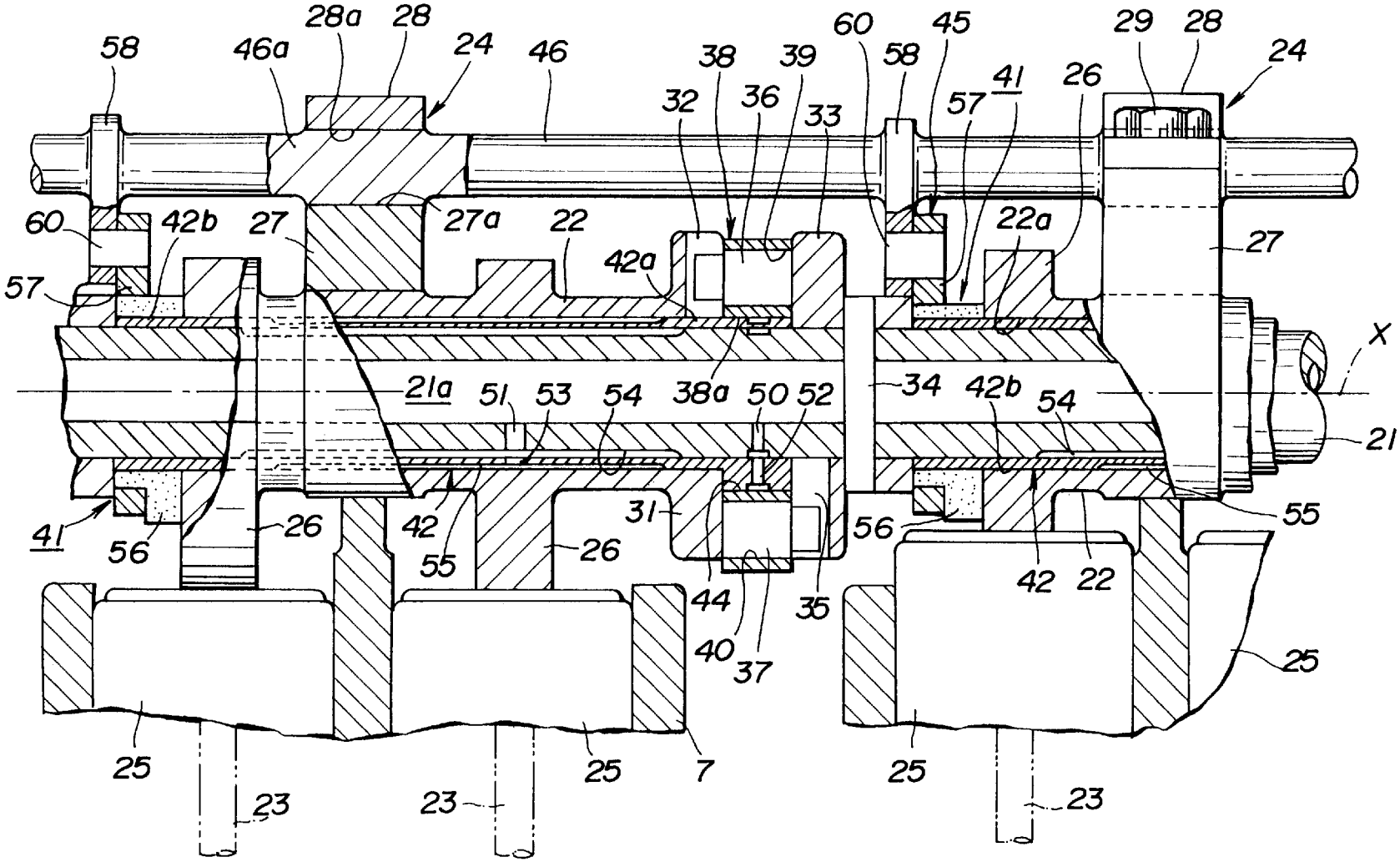
FIG. 10 is a similar view to FIG. 1, illustrating a third embodiment.
Figure 11:
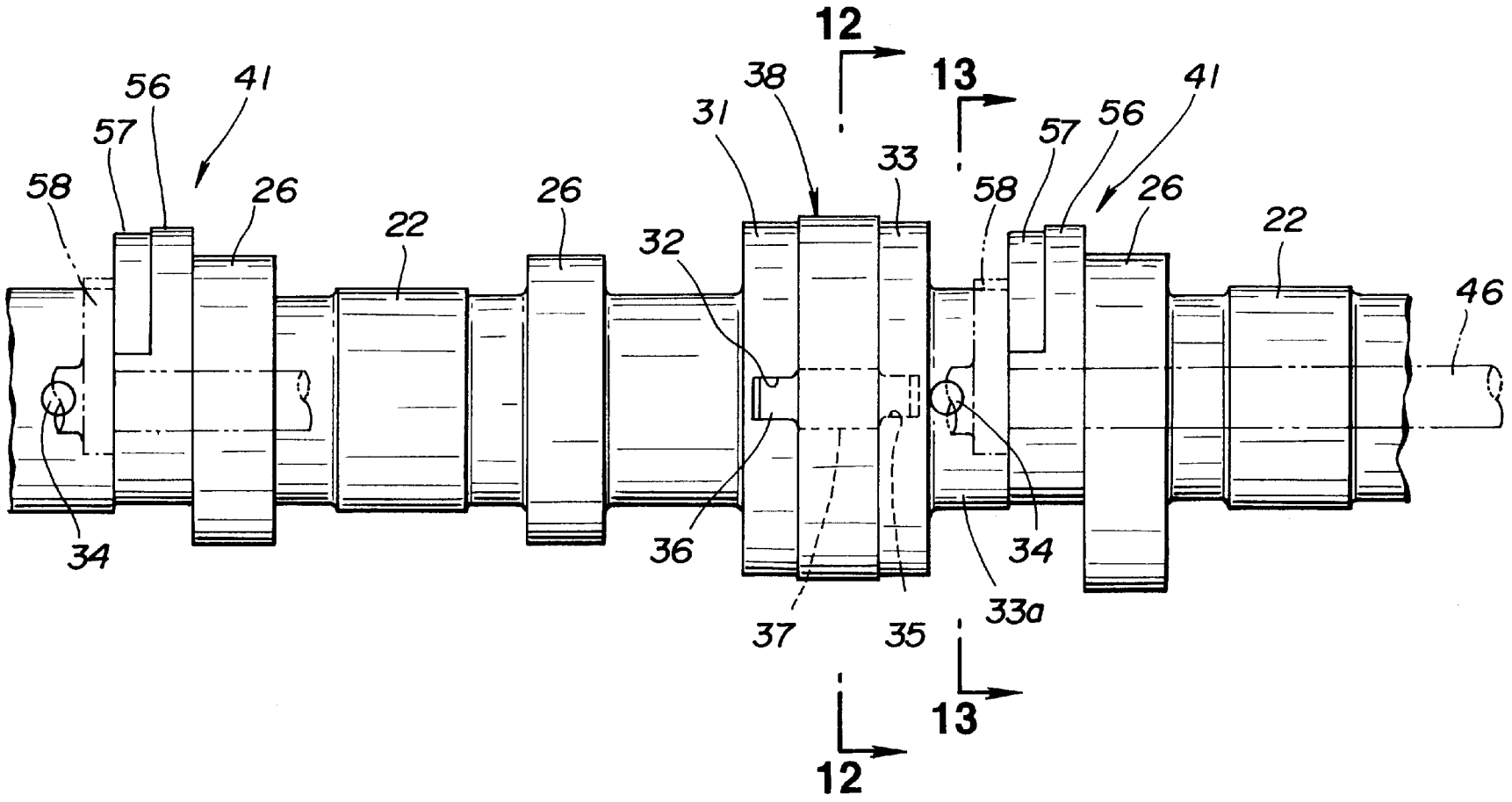
FIG. 11 is a top plan view of the third embodiment.
Figure 12:
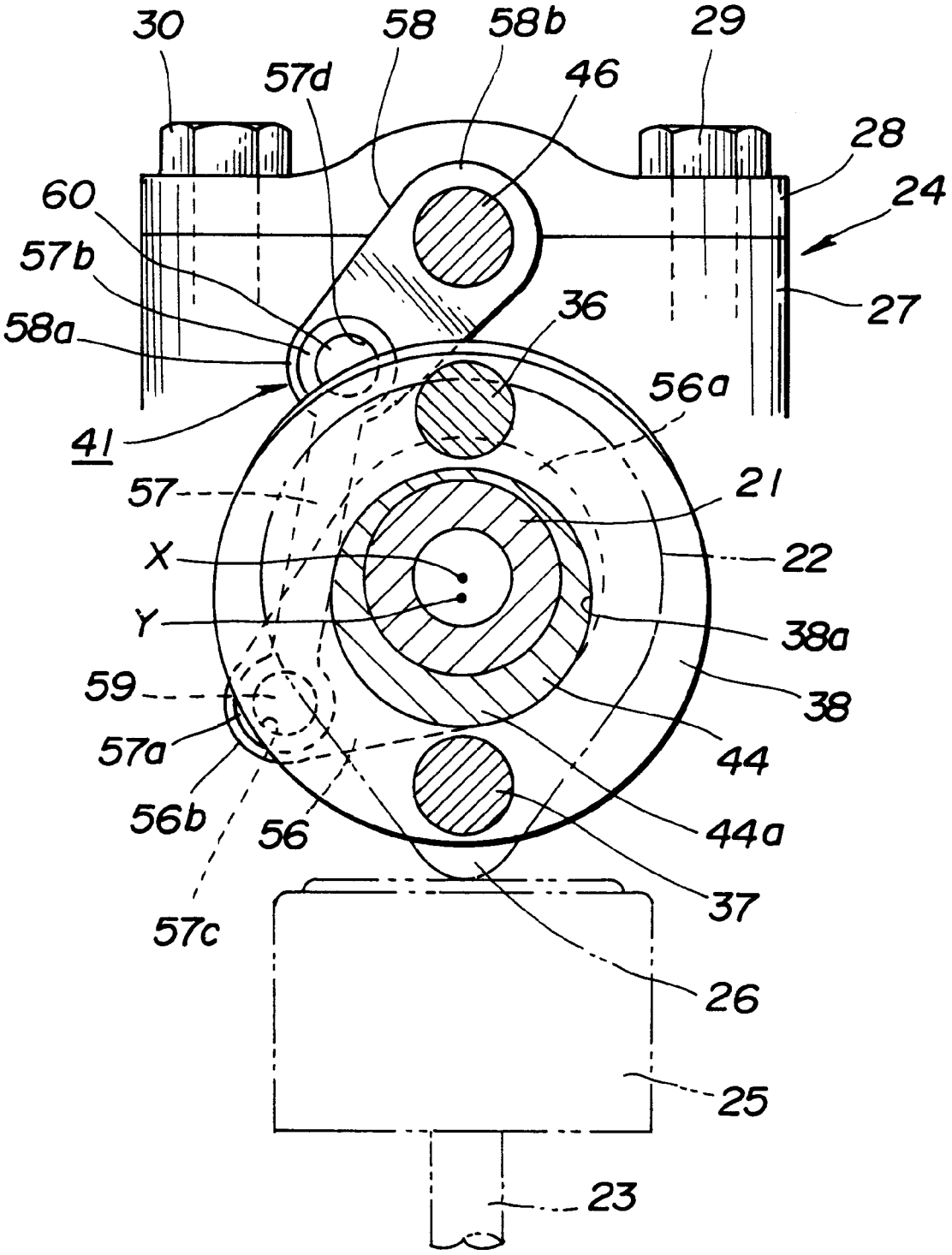
FIG. 12 is a section taken though the line 12—12 in FIG. 10.
Figure 13:
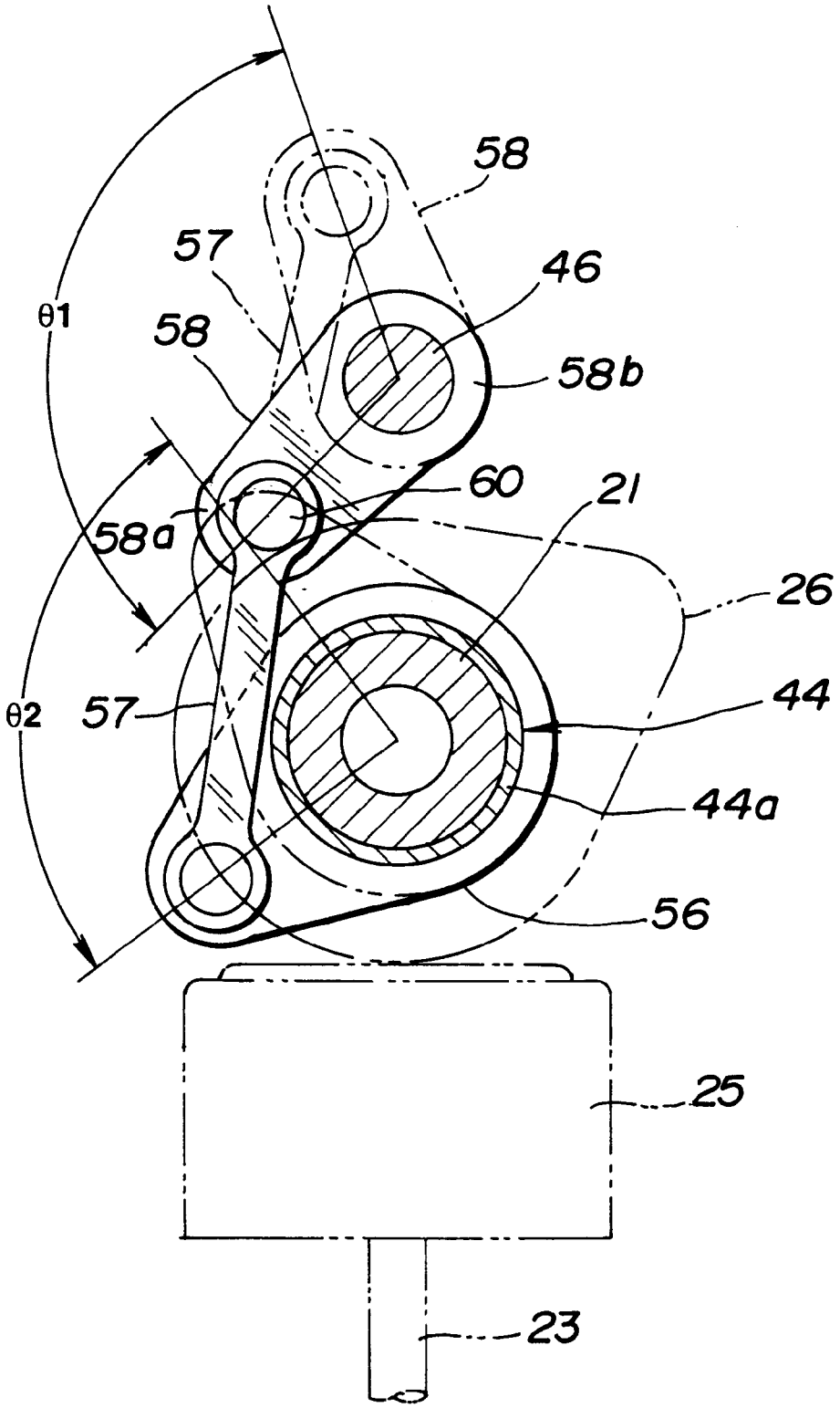
FIG. 13 is a section taken though the line 13—13 in FIG. 10.

Referring to FIGS. 10, 12 and 13, the link mechanism includes a rain drop like first link 56 fixedly coupled at one end portion 56*a* with a torque transmission sleeve 42 at its end portion 42*b*. A rod like second link 57 is pivoted at one end 57*a* to the opposite end portion 56*b* of the first link 56. A rain drop like third link 58 is pivoted at one end portion 58*a* to the second link 57 at the opposite end portion 57*b* thereof. At the opposite end portion 58*b* thereof, the third link 58 is fixedly coupled with a control rod or shaft 46.

The first link 56 is enlarged in diameter at the one end portion 56*a* as compared to a small diameter at the opposite end portion 56*b*. The enlarged diameter one end portion 56*a* is formed with a bore receiving the opposite end portion 42*b* of the sleeve 42. A first support pin 59 is fixedly connected to the opposite end portion 56*b* of the first link 56. The one end portion 57*a* of the second link 57 is formed with a pin-receiving hole 57*c* that receives the first support pin 59. This connection allows pivotal relation between the second link 57 and the first link 56. The opposite end portion 57*b* of the second link 57 is formed with a pin receiving hole 57*d* that receives a second support pin 60 fixed to the one end portion 58*a* of the third link 58. At the opposite end portion 58*b*, the third link 58 is fixedly coupled with the control shaft 46. Pivotal relation between the second and third links 57 and 58 is established by the second support pin 60 within the pin-receiving hole 57*d*. The first and send links 56 and 58 are generally parallel.

Figure 14:
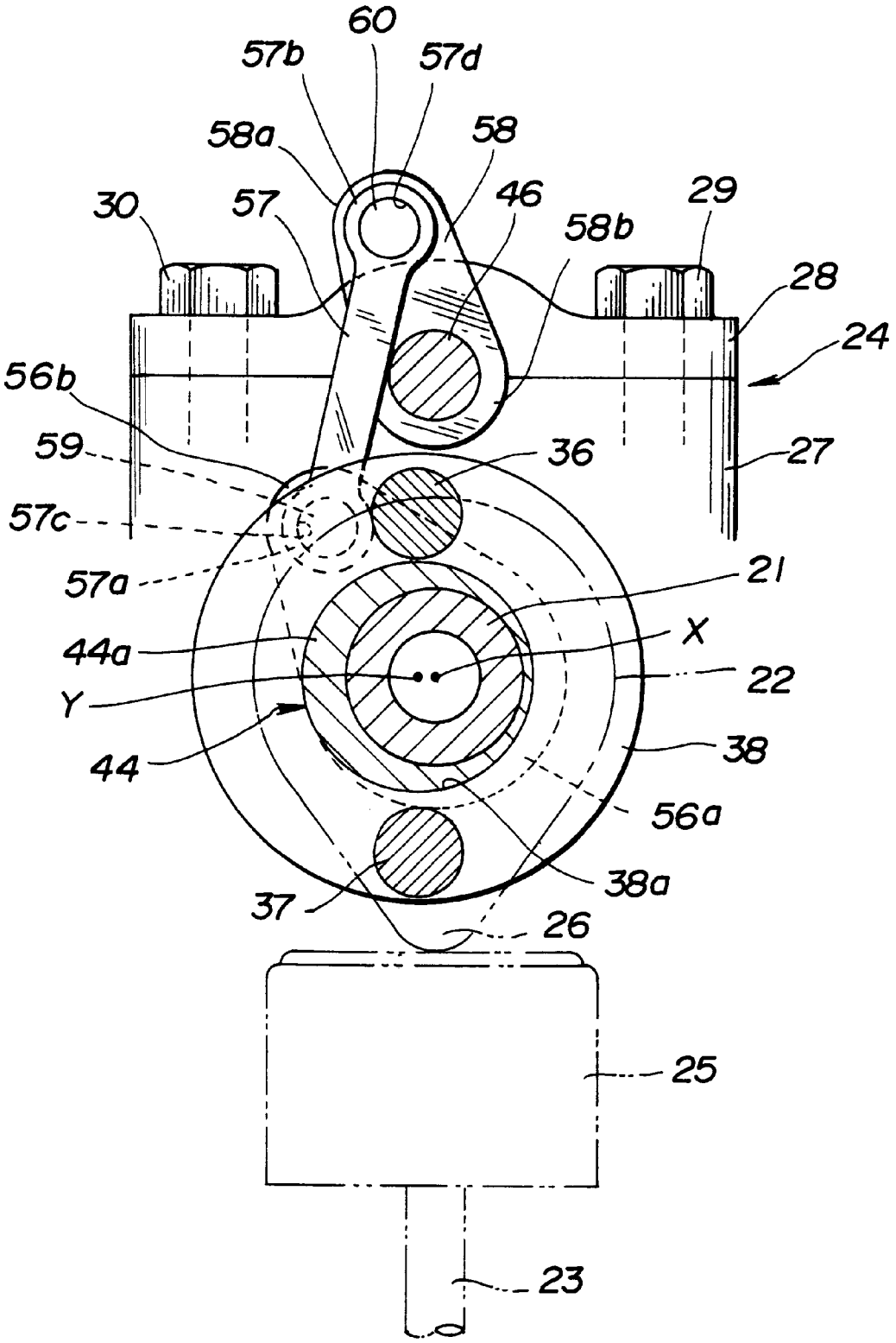
FIG. 14 is a section similar to FIG. 12.

At low engine speeds, the first link 56 is adjusted to a downwardly angled first position as illustrated in FIG. 12. At high engine speeds, the first link 56 is adjusted to an upwardly is angled second position as illustrated in FIG. 14. Turning the first link from the first position (FIG. 12) to the second position (FIG. 14) causes a cam ring 44 to turn clockwise, viewing in FIG. 12, through an angle θ2 of 90 degrees (see FIG. 13 also) to the second position shown in FIG. 14. In the second position, the axis Y of an intermediate member 38 is displaced laterally from the shaft axis X although in the first position the axis Y is displaced downwardly from the shaft axis. Turning the third link 58 via the control shaft 46 through an angle θ1 (see FIG. 13) causes the first link 56 to turn through the angle of θ2.

Figures 15A, 15B, 15C:
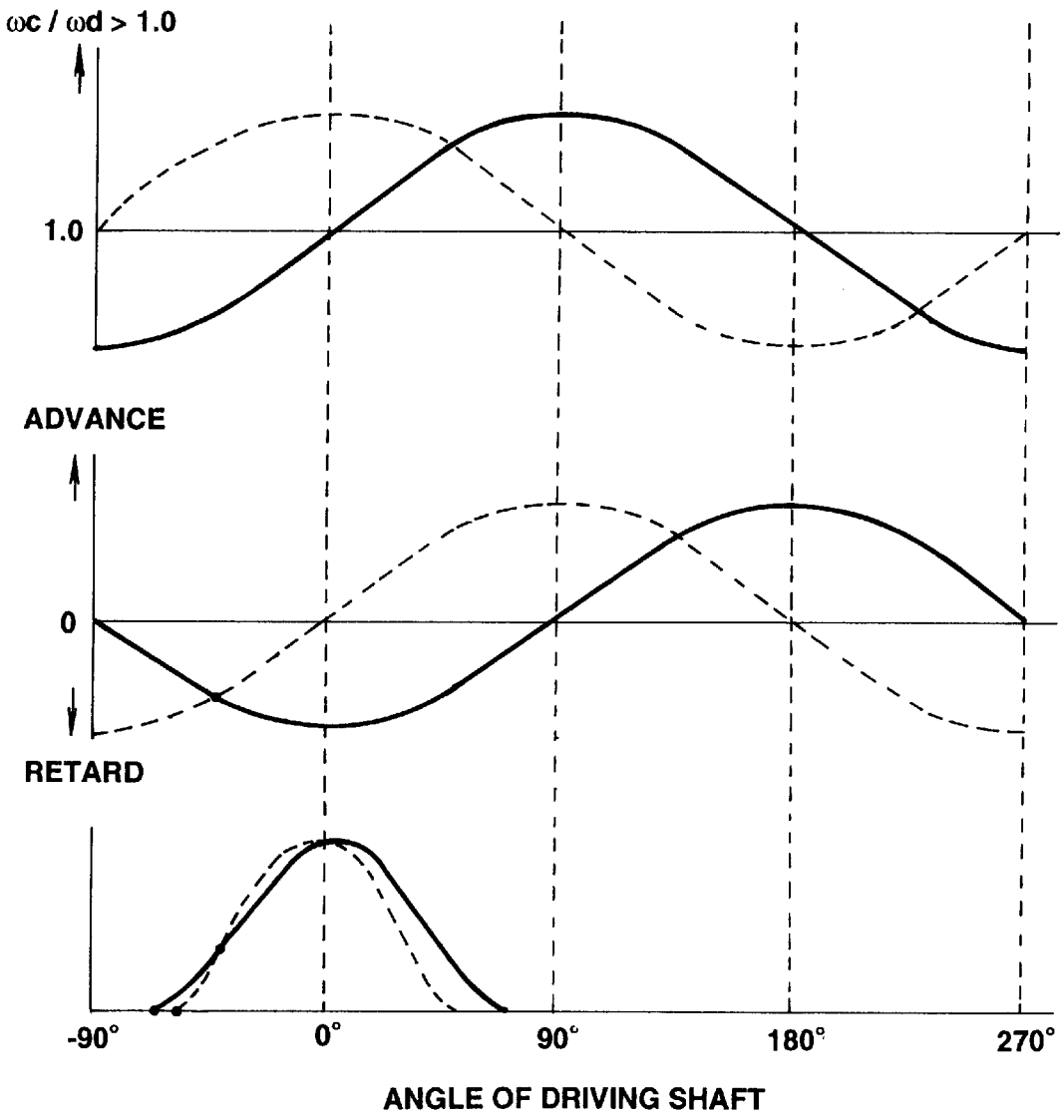
FIG. 15(A) is a graph illustrating the variation of the angular speed of a hollow cam relative to the angular speed of a driving shaft.
FIG. 15(B) is a graph illustrating the variation of the phase of the hollow cam.
FIG. 15(C) is a valve lift diagram.

Referring to FIGS. 15(A) to 15(C), the fully drawn line in FIG. 15(A) illustrates the variation of angle speed of a hollow cam 22 at high engine speeds when the link mechanism assume the second position as illustrated in FIG. 14. The fully drawn line in FIG. 15(B) illustrates the variation of the phase of the hollow cam 22 at high engine speed. The fully drawn line in FIG. 15(C) illustrates the valve lift diagram at high engine speeds. The dotted line in FIG. 15(A) illustrates the variation of the angle speed of the hollow cam 22 at low engine speeds when the link mechanism assume the first position as illustrated in FIG. 12. The dotted line in FIG. 15(B) illustrates the variation of the phase of the hollow cam 22 at low engine speed. The dotted line in FIG. 15(C) illustrates the valve lift diagram at low engine speeds.

What is claimed is:

1. A device for moving a cam relative to a driving shaft, comprising:

a driving shaft having shaft axis;

a hollow cam concentric with said driving shaft, said hollow cam 22 having one end portion and opposite end portion;

a drive member fixed to said driving shaft;

a driven member fixed said hollow cam at said one end portion thereof;

an intermediate member having an axis and disposed between said drive and driven members;

a first coupling connecting said drive member with said intermediate member at a first position spaced from said shaft axis;

a second coupling connecting said driven member with said intermediate member at a second position spaced from said shaft axis and spaced in an angular direction, with respect to said shaft axis, from said first position;

said intermediate member having a central bore through which said driving shaft extends;

a cam ring disposed within said central bore between said driving shaft and said intermediate member, said cam ring supporting said intermediate member.

2. A device as claimed in claim 1, further comprising:

a driver mechanism; and a power transfer mechanism between said driver and said cam ring.

3. A device as claimed in claim 2, wherein said transfer mechanism includes a torque transmission member that has one end connected to said cam ring and an opposite end drivingly associated with said driver mechanism.

4. A device as claimed in claim 3, wherein said driver mechanism includes a control shaft, and wherein said transfer mechanism includes a first gear fixedly coupled to said control shaft, and a second gear fixed to said opposite end portion of said torque transmission member, said first and second gears being intermeshed.

5. A device as claimed in claim 2, wherein said driving shaft has a supply passage for lubricating oil, and wherein said cam ring and said driving shaft have first and second radial passages, respectively, said first radial passage mating with and communicating with said second radial passage, said second radial passage communicating with said supply passage.

6. A device as claimed in claim 5, wherein said torque transmission member and said driving shaft 21 have oil reservoirs, respectively, each of which has an axial extension along said shaft axis.

7. A device as claimed in claim 6, wherein each of said oil reservoir extends continuously in a circumference direction.

8. A device as claimed in claim 6, wherein each of said oil reservoir includes axially extending grooves and a circumference groove interconnecting said axially extending grooves.

9. A device as claimed in claim 3, wherein said torque transmission member are supported at two spaced end portions that are spaced along said shaft axis on said driving shaft.

10. A device as claimed in claim 3, wherein said torque transmission member supports, at two spaced and portions that are spaced along said shaft axis, said hollow cam.

11. A device as claimed in claim 3, wherein said power transfer mechanism a link mechanism disposed between said torque transmission member and said driver mechanism.

12. A device as claimed in claim 11, wherein said link mechanism includes a first link fixedly connected to said torque transmission member, a second link, and a third link fixedly connected to a control shaft of said driver mechanism, said second link connected between said first and third links.

* * * * *